US009896158B2

(12) United States Patent
Modica et al.

(10) Patent No.: US 9,896,158 B2
(45) Date of Patent: Feb. 20, 2018

(54) UNIVERSAL HYDROFOIL CONNECTOR SYSTEM AND METHOD OF ATTACHMENT

(71) Applicant: Hydrofoiled, Inc., Vernon, CT (US)

(72) Inventors: Louis J. Modica, Pomfret Center, CT (US); Kenneth Glickman, Vernon, CT (US); Brian Kology, Rockville, CT (US); Timothy R. Cabbabe, Lincoln, RI (US)

(73) Assignee: Hydrofoiled, Inc., Vernon, CT (US)

( * ) Notice: Subject to any disclaimer, the term of this patent is extended or adjusted under 35 U.S.C. 154(b) by 0 days.

(21) Appl. No.: 15/432,235

(22) Filed: Feb. 14, 2017

(65) Prior Publication Data

US 2017/0152004 A1 Jun. 1, 2017

Related U.S. Application Data

(63) Continuation of application No. 14/800,731, filed on Jul. 16, 2015, now Pat. No. 9,586,651, which is a continuation of application No. 14/209,200, filed on Mar. 13, 2014, now Pat. No. 9,085,343.

(60) Provisional application No. 61/783,168, filed on Mar. 14, 2013.

(51) Int. Cl.

| | |
|---|---|
| ***B63B 1/24*** | (2006.01) |
| ***B63B 35/79*** | (2006.01) |
| ***B63B 35/71*** | (2006.01) |

(52) U.S. Cl.

CPC ..... *B63B 1/248* (2013.01); *B63B 1/242* (2013.01); *B63B 35/71* (2013.01); *B63B 35/7923* (2013.01); *B63B 2035/715* (2013.01)

(58) Field of Classification Search

CPC ..... B63B 1/24; B63B 1/242; B63B 35/71; B63B 35/73; B63B 35/7923; B63B 35/79

USPC ..... 114/273, 274, 280, 281, 282; 441/79

See application file for complete search history.

(56) References Cited

U.S. PATENT DOCUMENTS

| | | | | |
|---|---|---|---|---|
| 2,815,518 | A | 12/1957 | Kuehn | |
| 6,234,856 | B1 | 5/2001 | Woolley | |
| 7,832,349 | B2 | 11/2010 | Dansie | |
| 7,926,437 | B2 | 4/2011 | Townsend | |
| 9,085,343 | B2 * | 7/2015 | Modica | B63B 1/24 |
| 9,586,651 | B2 * | 3/2017 | Modica | B63B 1/24 |
| 2005/0266746 | A1 | 12/2005 | Murphy | |
| 2008/0305698 | A1 | 12/2008 | Rosiello | |

* cited by examiner

*Primary Examiner* — Lars A Olson

(74) *Attorney, Agent, or Firm* — Alix, Yale & Ristas, LLP

(57) ABSTRACT

A universal hydrofoil comprises a hydrofoil assembly, a universal mount assembly and a plurality of lateral connectors. The hydrofoil assembly has a longitudinal axis and includes a centerfoil having first and second longitudinal ends. A foil assembly is disposed at the centerfoil second end and includes a fuselage, a wing at a fuselage first end and a tail at a fuselage second end. The universal mount assembly comprises a base having first and second mounting surfaces. The second mounting surface defines a mounting interface configured to reversibly mate with the centerfoil first end. Lateral supports having a pair of arms projecting from a central beam are selectively engageable with the base. The lateral connectors are adjustably secured within the lateral channel and configured to engage a structural feature of a craft.

20 Claims, 22 Drawing Sheets

UNIVERSAL HYDROFOIL CONNECTOR SYSTEM AND METHOD OF ATTACHMENT

CROSS-REFERENCE TO RELATED APPLICATIONS

This application is a continuation of U.S. patent application Ser. No. 14/800,731 filed on Jul. 16, 2015, which application is a continuation of U.S. patent application Ser. No. 14/209,200 filed on Mar. 13, 2014, now U.S. Pat. No. 9,085,343 which claims the priority of U.S. Patent Application No. 61/783,168 filed on Mar. 14, 2013, the entirety of which applications are incorporated herein by reference in their entirety.

BACKGROUND OF THE DISCLOSURE

The present disclosure relates to craft used in water sports, and more particularly, to a connector system for watercraft used in surf style water sports.

Surf style water sports have been practiced and refined since ancient Polynesians began riding waves long before contact with European explorers. A variety of contemporary water sports utilize a multitude of different boards, watercraft and methods of propulsion to ride on and over the water. For example, surfing, stand-up paddleboarding, windsurfing, kitesurfing, and wakeboarding, each utilizes a different style of board to traverse the water and waves.

Despite variability between the boards used in the various water sports disciplines, all boards for use in surf-style water sports utilize fins of various sizes and shapes to aid in steering. Traditional methods of attaching fins to surf-style water sports boards require various combinations of epoxy and fiberglass cloth to permanently secure the fins to the base. Removable fin systems give greater flexibility to change the fins based on the rider's skill-level and weather conditions.

In an exemplary type of removable fin system, a fin fixing element is inserted into the polystyrene core of the board during fabrication and the fin is releasably secured thereto. One commercially available example of a fin fixing element comprises a longitudinally extending box, defining a cavity running substantially the entire length of the box. An alternate configuration for a removable fin system comprises a plurality of fin-fixing elements each sized to releasably secure one of a plurality of structures projecting from a single fin.

The speed and maneuverability of traditional surf-style water sports boards are hampered by the drag that the bottom of the board produces while travelling across the water surface. A great amount of force (whether wind, wave, or mechanically generated) is not transferred into forward motion because of the negative effects of drag. Mounting a hydrofoil to the bottom surface of a surf-style water sports board universally reduces drag and allows the rider to attain higher speeds than with traditional on-surface boards. An example of a hydrofoil adapted for use in a kitesurfing board is disclosed in U.S. Pat. No. 7,926,437.

Despite the increasing popularity of surf-style water sports and the increase in speed that a hydrofoil confers, the cost of surf-style boards having hydrofoils is prohibitive. In addition to the price of the high-end materials used to construct the hydrofoil, most hydrofoils are permanently secured to the bottom surface of the board. Consequently, a rider seeking to use a hydrofoil in different conditions or across different disciplines of surf-style water sports must purchase multiple hydrofoil boards.

Accordingly there is a need for a cost-effective surf-style water sports board having a hydrofoil.

SUMMARY

Briefly stated, a universal hydrofoil comprises a hydrofoil assembly and a universal mount assembly.

The hydrofoil assembly has a longitudinal axis and includes a centerfoil and a foil assembly. The centerfoil is coaxial with the longitudinal axis and has first and second longitudinal ends. The foil assembly is disposed at the centerfoil second end and includes a fuselage connecting a wing and a tail at fuselage first and second ends, respectively.

The universal mount assembly comprises a base that has a central axis perpendicular to the longitudinal axis and includes first and second mounting surfaces. The second mounting surface defines a mounting interface configured to reversibly mate with the centerfoil first end. A plurality of lateral supports is slideably positionable along the base in a direction parallel to the base central axis. Each of the lateral supports has a pair of arms that project from a central beam and each arm defines a lateral channel.

A plurality of connectors are also provided, which are adjustably secured within the lateral channels and configured to reversibly engage a structural feature of one of a plurality of craft. In one embodiment, a configuration of the connector is selected to cooperate with the pre-existing fin fixing elements utilized by manufacturers of various surf-style water sports boards. In another embodiment, the structural feature may comprise a void defined by the hull of a self-propelled craft such as a kayak. The connectors may be secured to the universal mount in a plurality of configurations for attachment to a craft having any dimension, and a connector for any conceivable spatial configuration.

One universal hydrofoil embodiment comprises a hydrofoil assembly having a longitudinal axis and including a centerfoil coaxial with the longitudinal axis and having a first and second longitudinal ends. A foil assembly is disposed at the centerfoil second end. The foil assembly includes a fuselage having a wing at a fuselage first end and a tail at the fuselage second end. A universal mount assembly comprises a base having a central axis perpendicular to the longitudinal axis and having first and second mounting surfaces. The second mounting surface defines a mounting interface configured to mount the centerfoil first end. A plurality of lateral supports each having a pair of arms project from a central beam which is selectively engageable with the base. The lateral support is slidably positionable along the base in a direction coaxial with the base central axis. A plurality of lateral connectors are adjustably positionable along an arm and secured to the arm and configured to engage a structural feature of a craft. The first longitudinal end of the centerfoil is engageable with the mounting interface of the base.

In one embodiment, the base comprises an elongated track configured coaxial with the central axis. The track has a pair of rails. Each of the rails is a parallel to the central axis. The central beam of the lateral support includes a pair of fingers defining a pair of pockets configured to secure the lateral support to the base at the rails such that the fingers engage the grooves and the pockets receive the rails. The central beam may comprise an arcuate segment defining a first cutout sized to receive a first stabilizer projecting at the centerfoil first end in a direction parallel with the base central axis and transverse to the longitudinal axis. The central beam may also define a second cutout axis intermediate the first cutout and the pockets and laterally intermediate the arms. The second cutout is preferably sized to receive a second stabilizer projecting intermediate the first stabilizer and the centerfoil first end in a direction coaxial with the base central axis and transverse to the longitudinal axis.

The centerfoil first end has a plurality of longitudinal projections and the mounting interface comprises a plurality of cavities sized to receive the longitudinal projections of the centerfoil first end to adjustably mount the hydrofoil assembly to the universal mount such that a mounted position of the centerfoil is adjustable in a direction coaxial with the central axis of the base.

The centerfoil first end may have a single longitudinal projection and the mounting interface may comprise a single cavity oriented coaxial with the central axis of the base and configured to receive the longitudinal projection to mount the hydrofoil assembly to the universal mount. The centerfoil second end may have a single longitudinal projection and the fuselage may define a single cavity sized to receive the longitudinal projection to mount the centerfoil to the fuselage.

Each of the connectors may comprise a generally cylindrical member which projects in a direction perpendicular to the arms of the lateral support and parallel with the longitudinal axis and defining a hole configured to receive a threaded fastener wherein a portion of the cylindrical member expands radially outwardly on receiving the threaded member.

In another embodiment, each of the connectors comprises a fin insert assembly and an attachment assembly. The fin insert assembly is configured for use with a pre-existing fin connector receptacle for a surf-style watercraft. The connectors may be configured for use with a plurality of pads defining a pair of arcuate slots on one surface. A male portion of a bayonet connector system projects from the attachment assembly on a surface opposite the fin connector assembly. The pair of arcuate slots comprises a female portion of the bayonet connector system. Each of the pads preferably defines a laterally oriented bore sized to receive the arms of the lateral support wherein a fastener secures each of the pads within the lateral slot.

The arms and the central beam of each lateral support include a peripheral wall and a plurality of webs intermediate the peripheral wall wherein the webs define a plurality of fluid flow channels oriented to allow water to flow through the lateral supports at a direction parallel with the central axis of the base.

In another embodiment, a universal hydrofoil is connectable to at least one anchor point on a craft. The universal hydrofoil comprises a hydrofoil assembly having a longitudinal axis and comprising a centerfoil coaxial with the longitudinal axis and the first and second longitudinal ends. A fuselage defines a central axis and is connected to the centerfoil at the first longitudinal end and has a wing and a tail. The universal mount assembly comprises a base defining a plurality of laterally oriented arms. A plurality of connectors is configured to engage the anchor point on the craft. The connectors are adjustable laterally and in a direction parallel to the central axis for selective cooperation with the anchor point on the craft.

The base may comprise an elongated track configured coaxial with a base central axis and having a plurality of lateral supports selectively engageable with the base and each having a pair of arms projecting from a central beam and defining laterally oriented channels.

The craft, to which the universal hydrofoil connects, may comprise a surf board, a wind surfer, a kite board, a kayak or a wake board.

Water sports enthusiasts may utilize the universal hydrofoil of the current disclosure on multiple boards and across the various disciplines of surf-style water sports. The universal hydrofoil of the current disclosure is a cost-effective means to transform any surf-style water sports board into a hydrofoil board, obviating the need for multiple individual hydrofoil-boards.

BRIEF DESCRIPTION OF THE DRAWINGS

Aspects of preferred embodiments will be described in reference to the Drawing, wherein like numerals reflect like elements.

DETAILED DESCRIPTION OF THE PREFERRED EMBODIMENT

Embodiments of a universal hydrofoil board connector system will now be described with reference to the Figures, wherein like numerals represent like parts throughout the Figures. Throughout the specification, reference is made to a craft. The craft may comprise a surf-style watersports board or small self-propelled watercraft. One of ordinary skill in the art will understand that the style of surf-style watersports board is interchangeable, and may comprise inter alia: a surfboard, a stand-up paddleboard, a kiteboard, a windsurfer, a wakeboard, or a sit-down style hydrofoil board. The self-propelled watercraft is also interchangeable and may alternatively comprise a canoe, a sea kayak, a whitewater kayak, a surf kayak, a recreational kayak, a sit-on-top kayak, a surf-ski or a racing kayak without departing from the scope of the claims.

Figure 1:
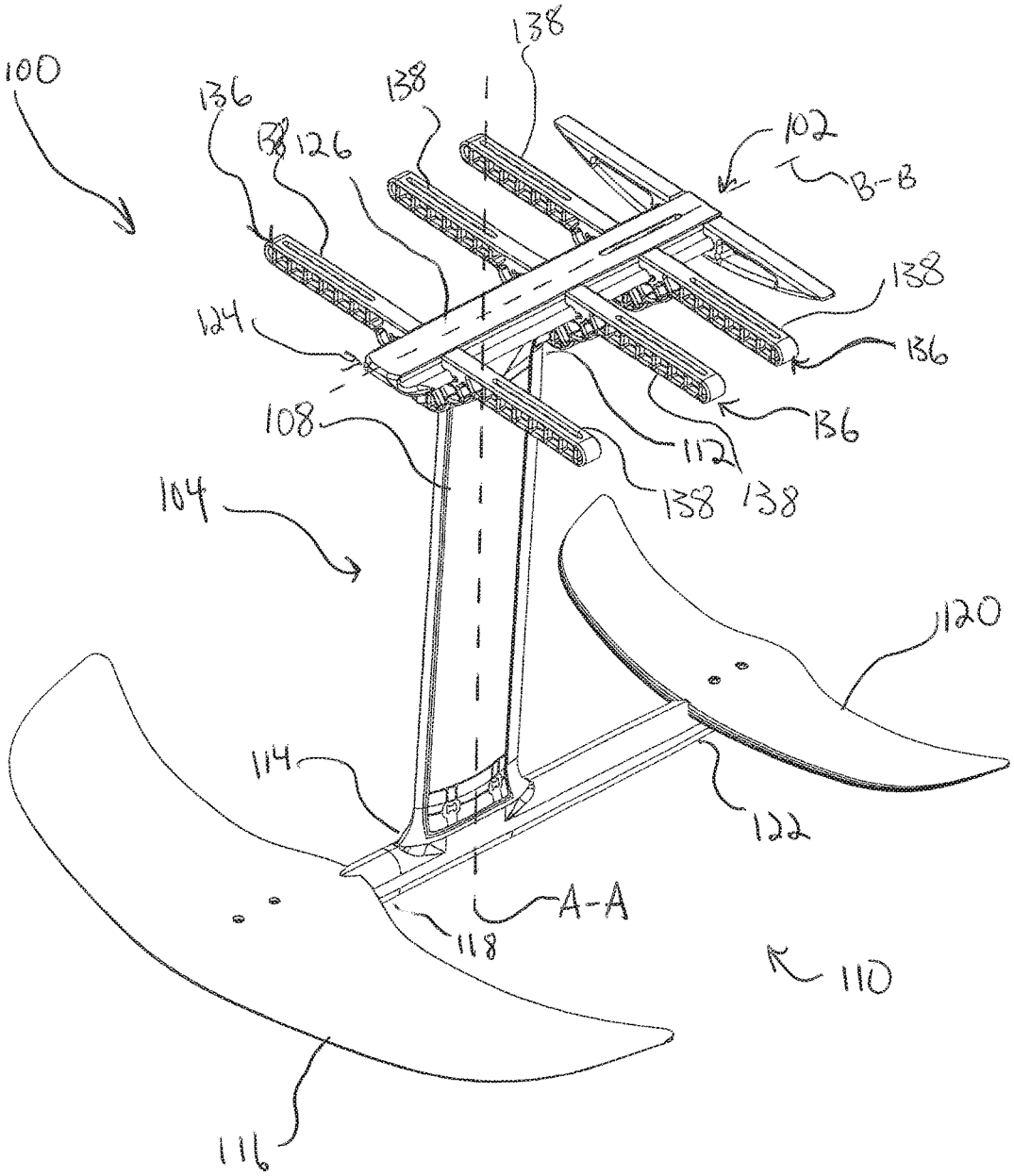
FIG. 1 is a perspective view, partially in phantom, of one embodiment of a universal hydrofoil and connector system of the current disclosure.

FIG. 1 depicts a universal hydrofoil 100. The hydrofoil 100 comprises a universal mount assembly 102 and a hydrofoil assembly 104. The hydrofoil assembly 104 has a longitudinal axis A-A, and comprises a centerfoil 108 generally coaxial with the axis A-A and a foil assembly 110. The length of the centerfoil 108 is variable, and a rider may utilize a hydrofoil assembly having a longitudinally longer or shorter centerfoil dependent upon skill level and weather conditions.

The centerfoil 108 has first and second longitudinal ends, 112 and 114, respectively. The universal mount assembly 102 is configured to reversibly mate with the first longitudinal end 112, while the foil assembly 110 is disposed at the second longitudinal end 114 of the centerfoil 108. A fuselage 111 has a dynamic shape, and connects a wing 116 disposed at a fuselage first end 118 and a tail 120 disposed at a fuselage second end 122.

Figure 18:
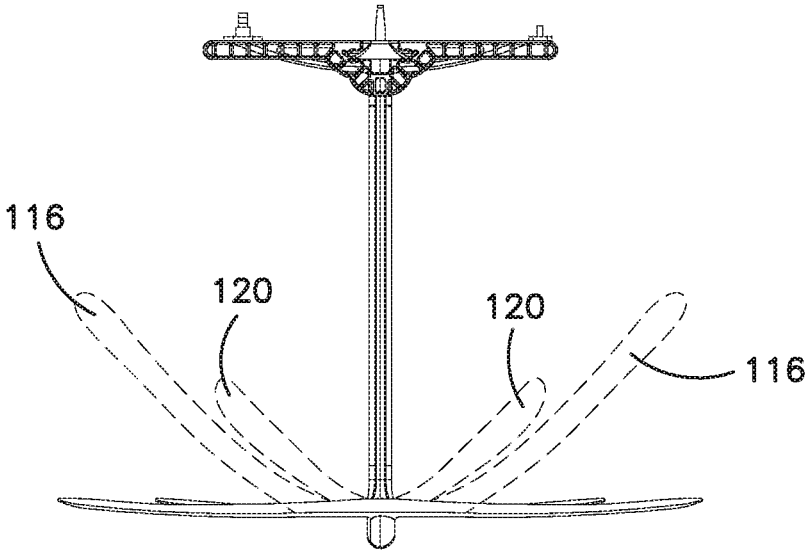
FIGS. 18 and 19 show frontal views of alternative embodiments of the wing and tail of the hydrofoil assembly.
Figure 19:
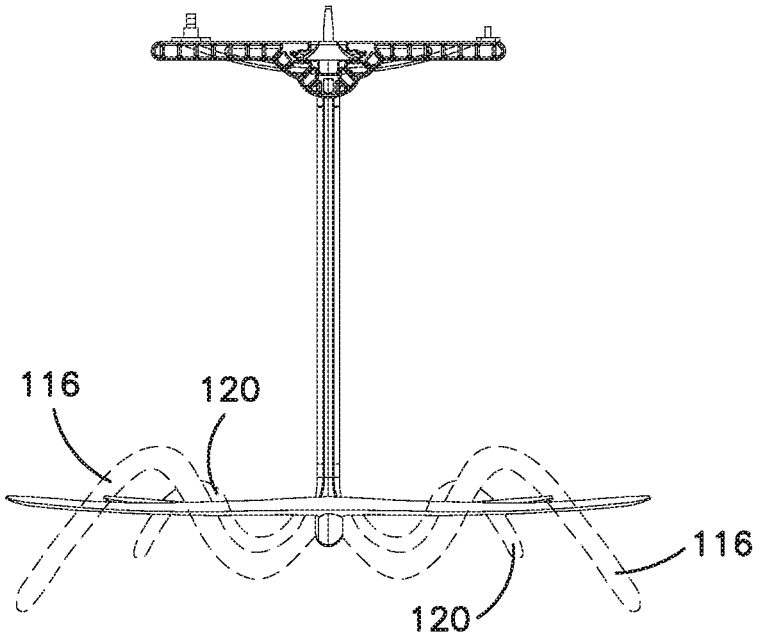
Figure 20:
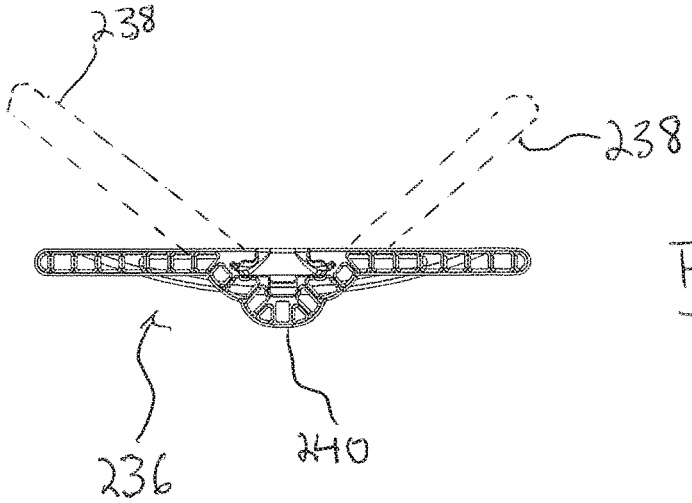
FIGS. 20 through 22 show alternative embodiments of the lateral support of the universal mount assembly.

The wing 116 is hydrodynamically configured to provide control in an axial direction so a rider may selectively lift the board off the water. The longitudinal position at which the rider may lift the board off the water surface is referred to as the "center of lift." The tail 120 is configured to provide lateral stability in the water when the rider is performing turning maneuvers while also providing lift in the axial direction. In one embodiment, the foil assembly 110 is designed to mimic the fluid dynamic properties of a NACA 63-412 airfoil. While the wing 116 and tail 120 depicted in FIG. 1 have a relatively planar configuration, alternative embodiments shown in phantom in FIGS. 18 and 19 may comprise an arcuate shaped wing and/or tail or an undulating shape.

Figure 2:
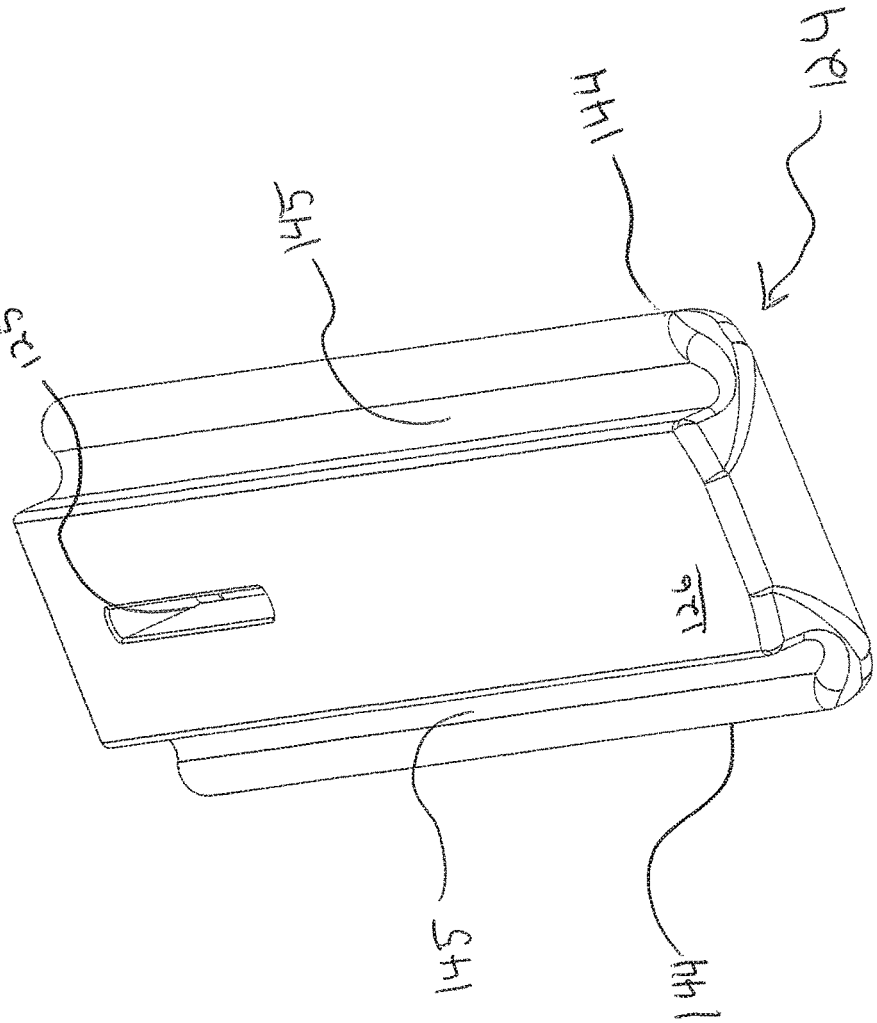
FIG. 2 is a perspective view of a base of the universal mount of the hydrofoil of FIG. 1, with particular emphasis on the first surface of the base, the hydrofoil assembly and the lateral supports being omitted for clarity.
Figure 3:
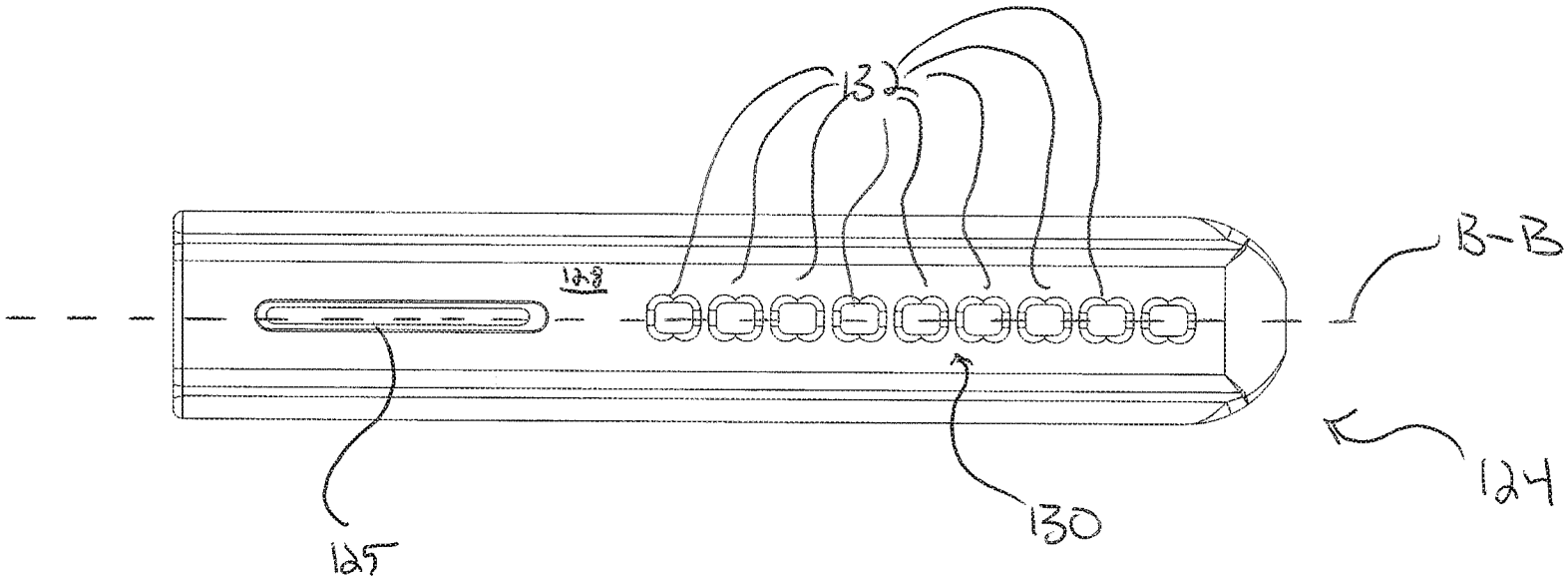
FIG. 3 is a bottom plan view of the base depicted in FIG. 2, the lateral supports being omitted for clarity.
Figure 4:
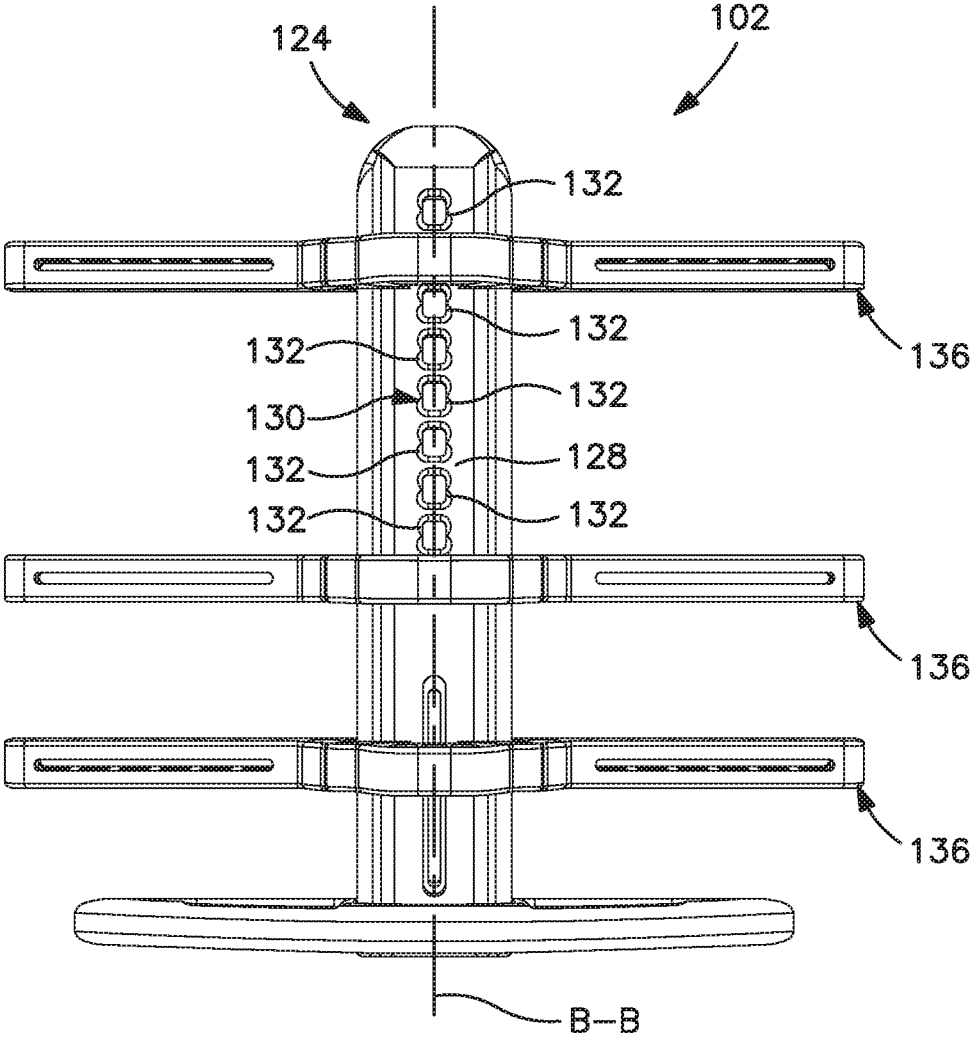
FIG. 4 shows the base of FIG. 3 including the lateral supports.
Figure 5:
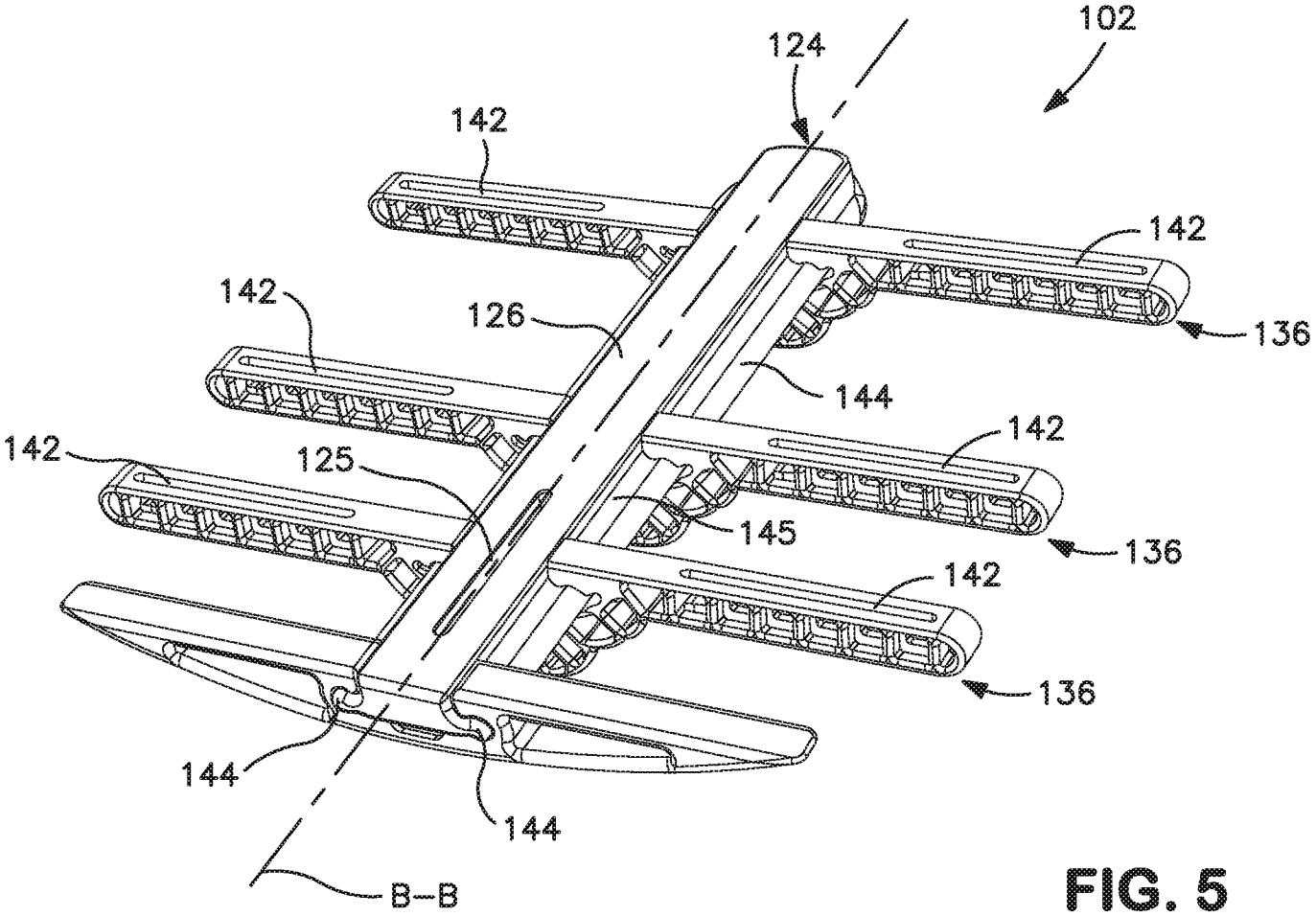
FIG. 5 is a perspective view of the base of FIG. 3 seen from the first mounting surface.

Referring to the embodiment shown in FIGS. 1 through 5, the universal mount 102 includes a base 124 having a central axis B-B oriented perpendicular to the longitudinal axis A-A of the centerfoil 108. The base 124 has first and second mounting surfaces 126 and 128, respectively. The second surface 128 defines a mounting interface 130 configured to reversibly mate with the centerfoil first end 112. The base 124 may be configured as an elongate track coaxial with the central axis B-B. The base 124 is configured so as to mount the hydrofoil assembly such that the foil assembly 110 is oriented in the direction of travel of the craft, and as such central axis B-B may be coaxial with or parallel to a direction oriented between the fore and aft of the craft. As best seen in FIGS. 2 through 3 and 5, the elongate track may additionally define a central slot 125 coaxial with central axis B-B and configured to receive a connector, which may comprise a center fin insert (discussed in further detail below).

Figure 24:
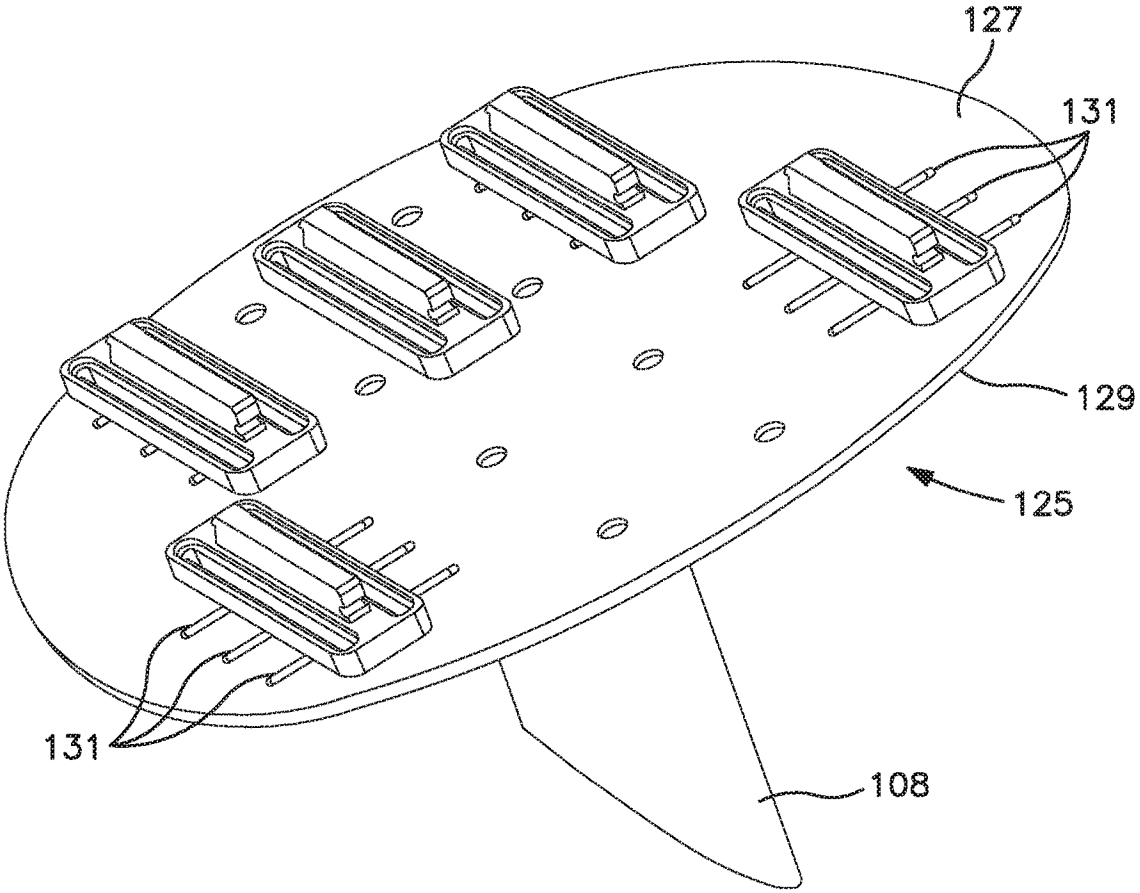
FIG. 24 shows a perspective view of an alternative embodiment of the base.

Referring to FIG. 24, the base 124 may alternatively comprise a hydrodynamic baseplate 125 having first and second surfaces 127 and 129, respectively. The hydrodynamic baseplate 125 is configured to produce as little drag as possible while moving through the water. Additionally, the baseplate 125 provides a secondary lifting force, complementing the forces imparted by the foil assembly 110 as the hydrofoil 100 accelerates. When installed on a board (not shown), the first surface 127 is oriented facing the water, while the second surface 129 is oriented facing a bottom surface of the board.

Figure 6:
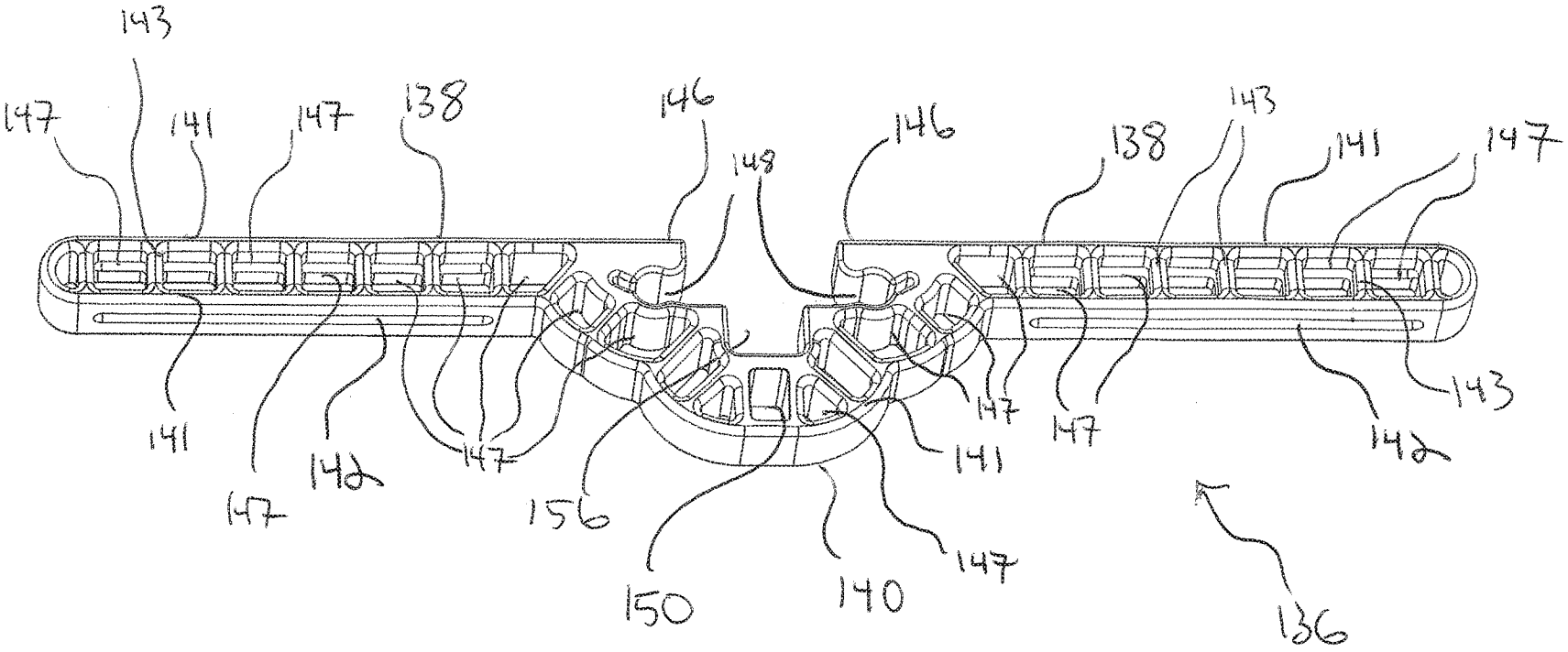
FIG. 6 is a perspective view, partially in perspective, of a lateral support shown in FIG. 4.
Figure 7:
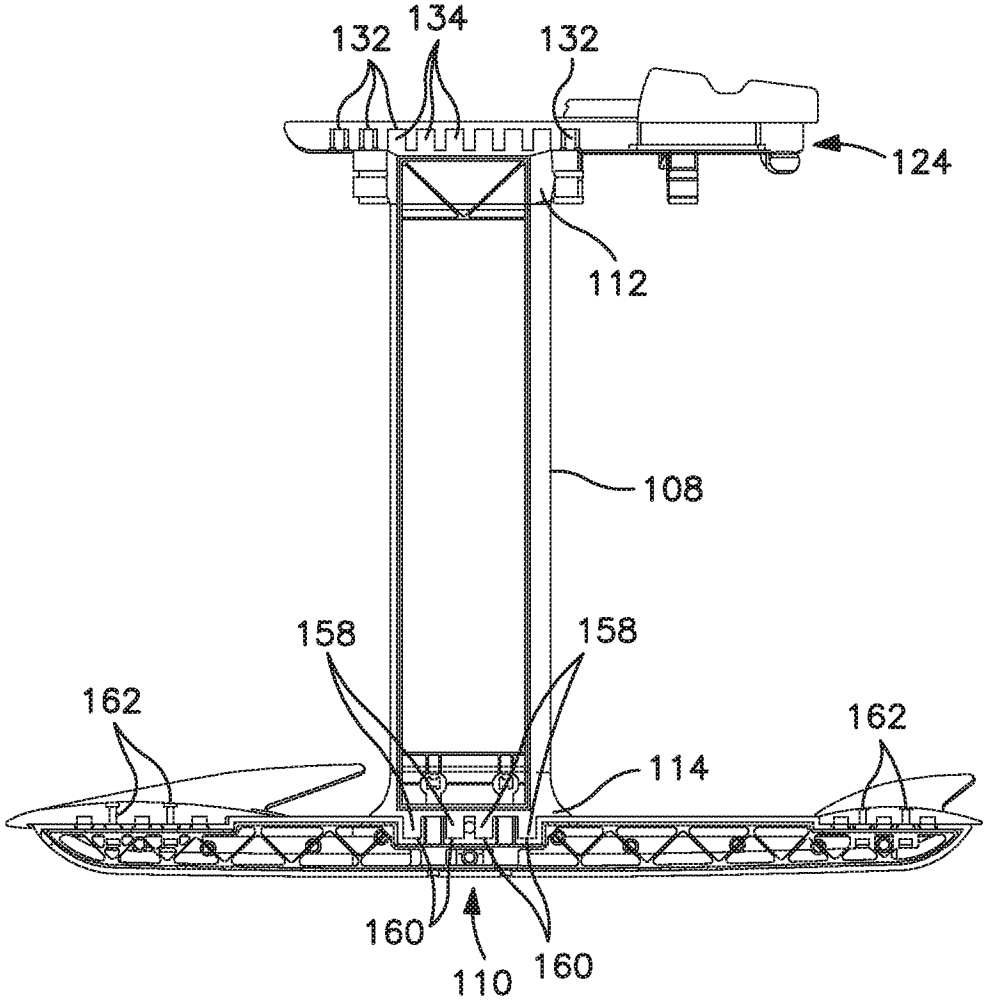
FIG. 7 is a cross-sectional view of the hydrofoil of FIG. 1 taken through the longitudinal axis A-A.
Figure 8:
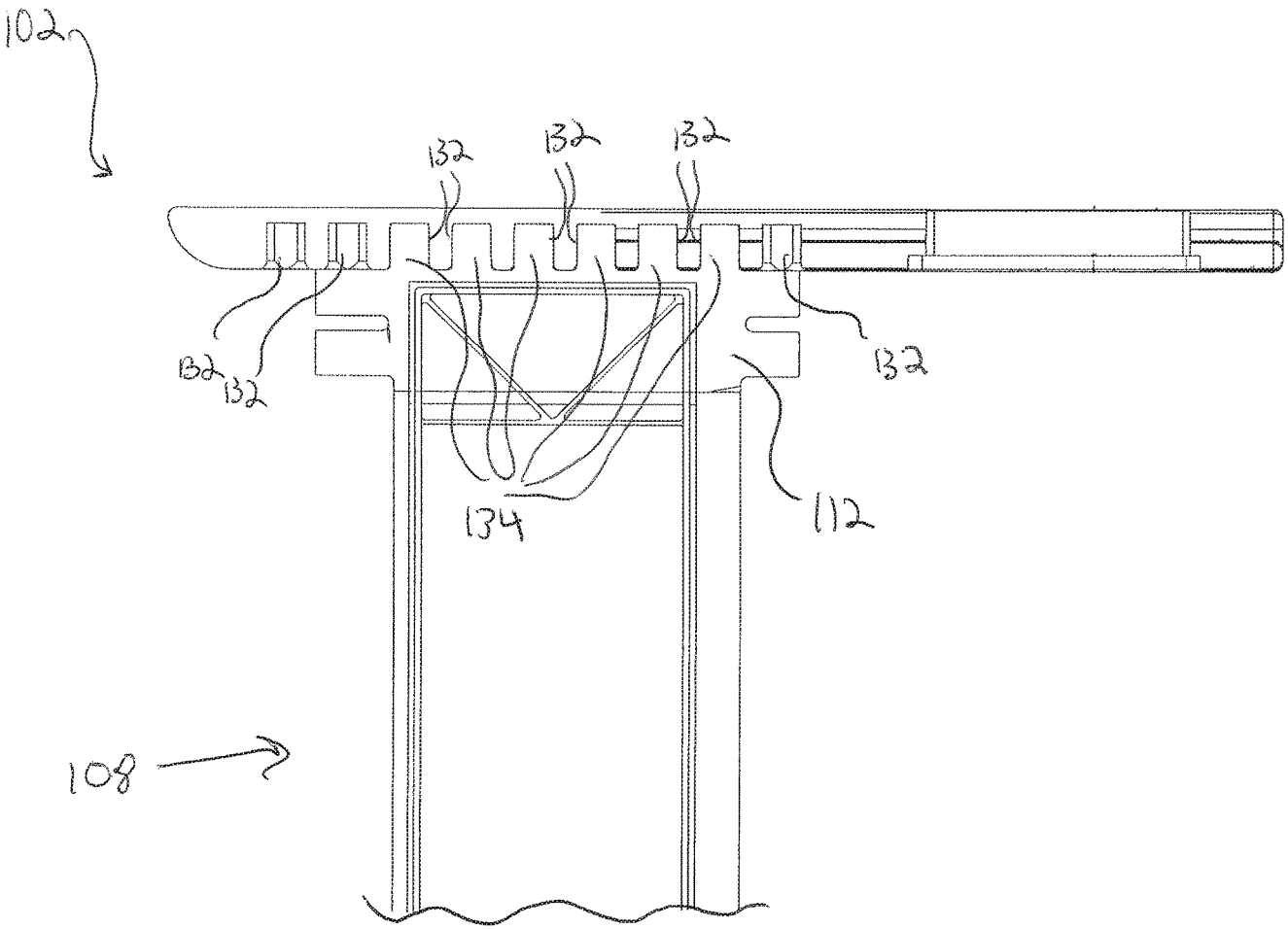
FIG. 8 shows the cross-sectional view of the hydrofoil of FIG. 7, with particular emphasis on the centerfoil first end and mounting structure of the universal mount.
Figure 9:
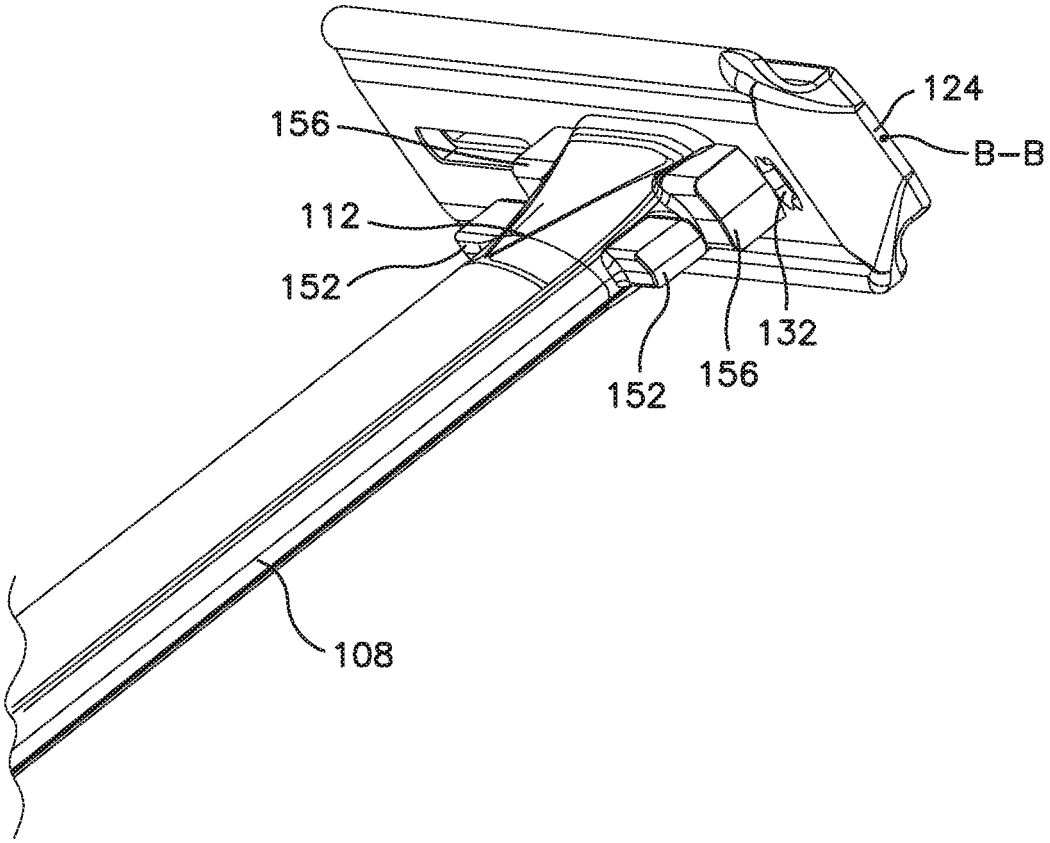
FIG. 9 shows a frontal view, partially in perspective, of the centerfoil first end.

Referring to FIGS. 3, 4, 7 through 9 and 11, the mounting interface 130 may comprise a plurality of cavities 132 sized to receive a first plurality of longitudinal projections 134 disposed at said centerfoil first end 112. The cavities 132 and the projections 134 are configured such that the hydrofoil assembly 104 may be adjustably mounted to the universal mount 102. As best seen in FIGS. 7 and 8, the centerfoil first end 112 has fewer projections 134 than the number of cavities 132 so that the hydrofoil assembly may be adjusted along central axis B-B, in the fore-aft direction as desired. Alternatively, the mounting surface may comprise a single cavity (not shown) coaxial with the central axis B-B, and sized to receive a single longitudinal projection (not shown) similar to a tongue and groove joint. As shown in FIGS. 1, 4, 5 and 6, a plurality of lateral supports 136 are selectively engageable with and slidably positionable along the base 124. Each of the lateral supports comprises a pair of arms 138 which project from a central beam 140. As best seen in FIG. 6, each of the arms 138 defines a lateral channel 142. As will be discussed in greater detail below, the lateral channels 142 allow the hydrofoil 100 to be connected to a multitude of different craft.

Figure 10:
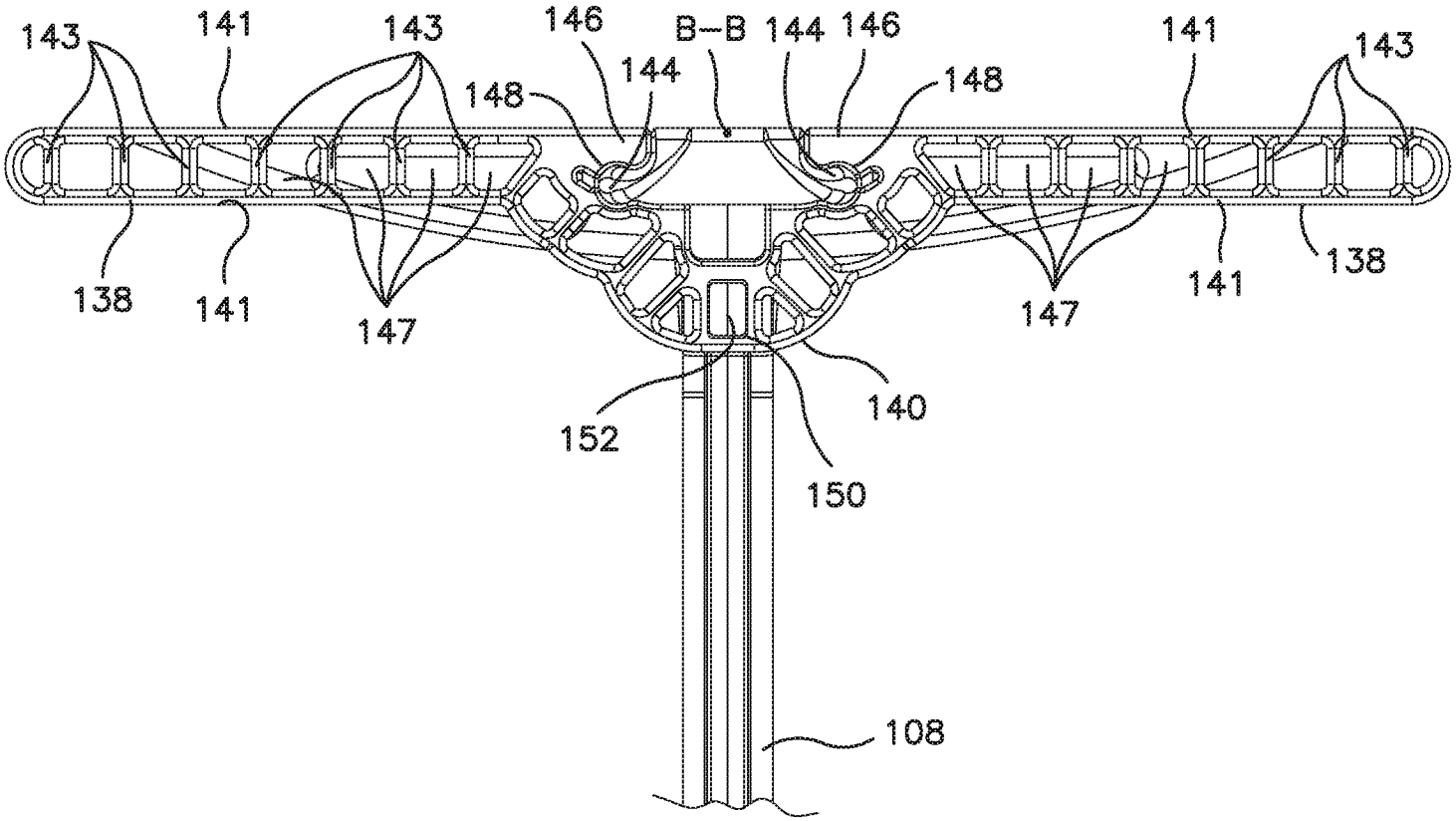
FIG. 10 shows a frontal view of one embodiment of the centerfoil first end, base and lateral support.
Figure 22:
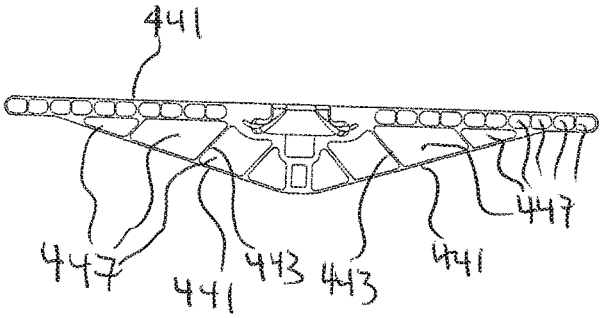

As shown in FIGS. 6 and 10, the arms 138 and central beam 140 of the lateral supports 136 may have a peripheral wall 141, having a sectional configuration which generally follows an outline of the lateral support 136. A plurality of webs 143 are disposed intermediate the peripheral wall 141. The webs 143 and the peripheral wall 141 define a plurality of fluid flow channels 147 oriented to allow water to flow through the lateral supports in a direction parallel with the base central axis B-B. The peripheral wall 141 and the webs 143 may provide an optimal ratio of strength to weight, while optimizing hydrodynamic flow around the hydrofoil before adequate speed has been attained to longitudinally lift the hydrofoil out of the water. An alternate embodiment of the peripheral wall 441, webs 443 and fluid flow channels 447 is shown in FIG. 22. In the embodiment of the base utilizing the baseplate 125 a plurality of laterally oriented slots 131 are defined on either side of the axis B-B and extend between the first and second surfaces 127 and 129. The laterally oriented slots 131 are defined on the baseplate 125 such that connectors may be arranged in any of a plurality of configurations (discussed in greater detail below), and operate similarly to the lateral supports 136.

Referring to the embodiment shown in FIGS. 2, 5, 6 and 10, a pair of rails 144 may project laterally from the base 124 adjacent the base second surface 128. A pair of engagement fingers 146 projecting adjacent said arms engage a lateral groove 145 defined by the rail 144, while a pocket 148 defined by the fingers 146 receives the rail 144 such that said lateral support 136 may slide coaxial with the central axis B-B of the base 124 in the fore-aft direction.

Figure 11:
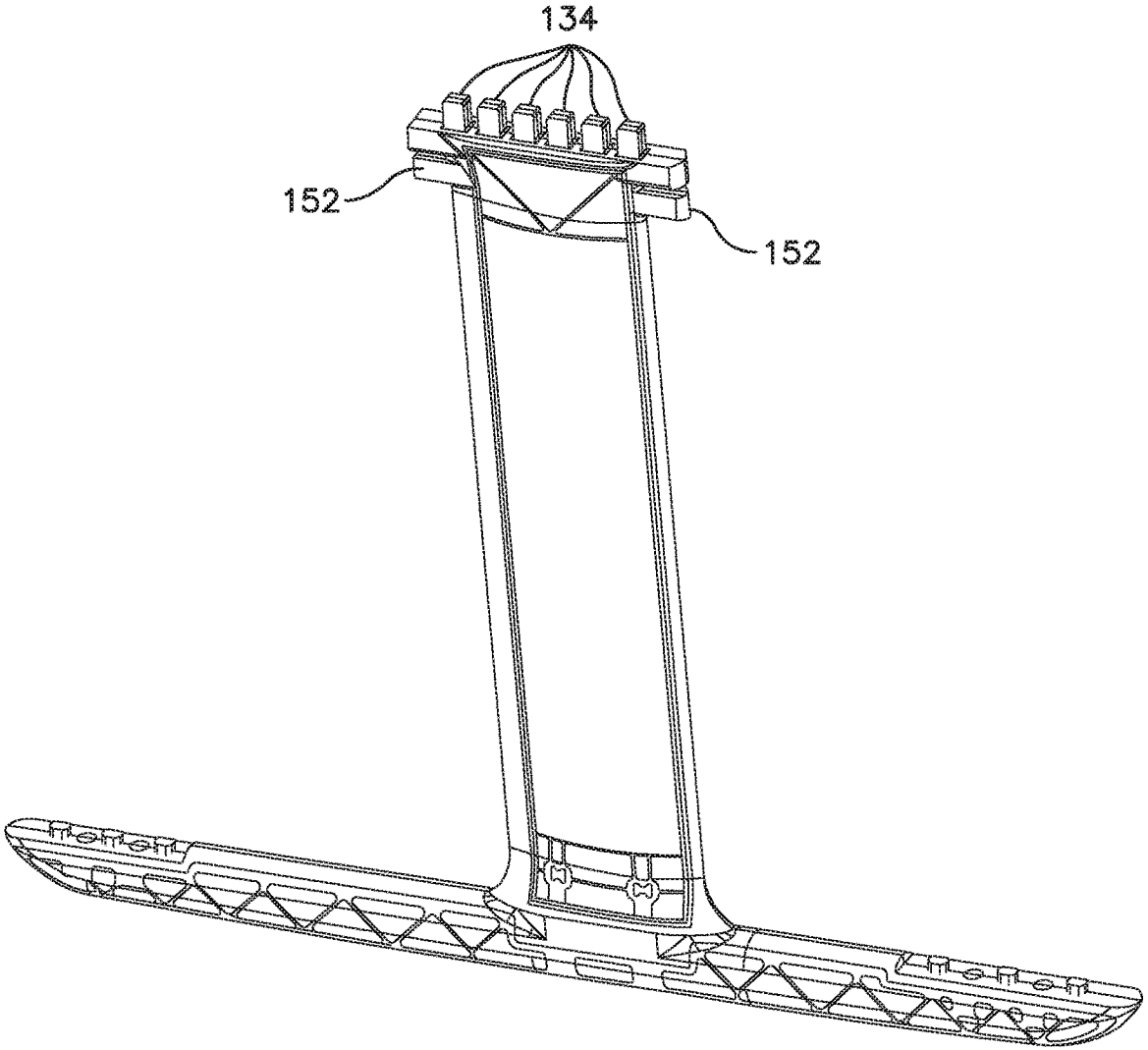
FIG. 11 shows a perspective view of one embodiment of the centerfoil assembly, the wing and tail being omitted for clarity.

As shown in FIGS. 6 and 9-11, the central beam 140 of each lateral support may be arcuate in shape and define a first cutout 150 configured to receive a first stabilizer 152. The first stabilizer 152 projects parallel to the central axis B-B and transverse to the longitudinal axis A-A at the centerfoil first end 112. As best seen in FIG. 11 the first stabilizer 152 may project from the centerfoil 108 in both the fore and aft direction. A second stabilizer 154 may project from the centerfoil 108 parallel to the central axis B-B and transverse to the longitudinal axis A-A intermediate the first stabilizer 152 and the centerfoil first end 112. A second cutout 156 defined axially adjacent the first cutout and laterally intermediate the arms 138 receives the second stabilizer 154. The first and second stabilizers 152 and 154 provide greater structural stability to the hydrofoil 100.

Figure 12:
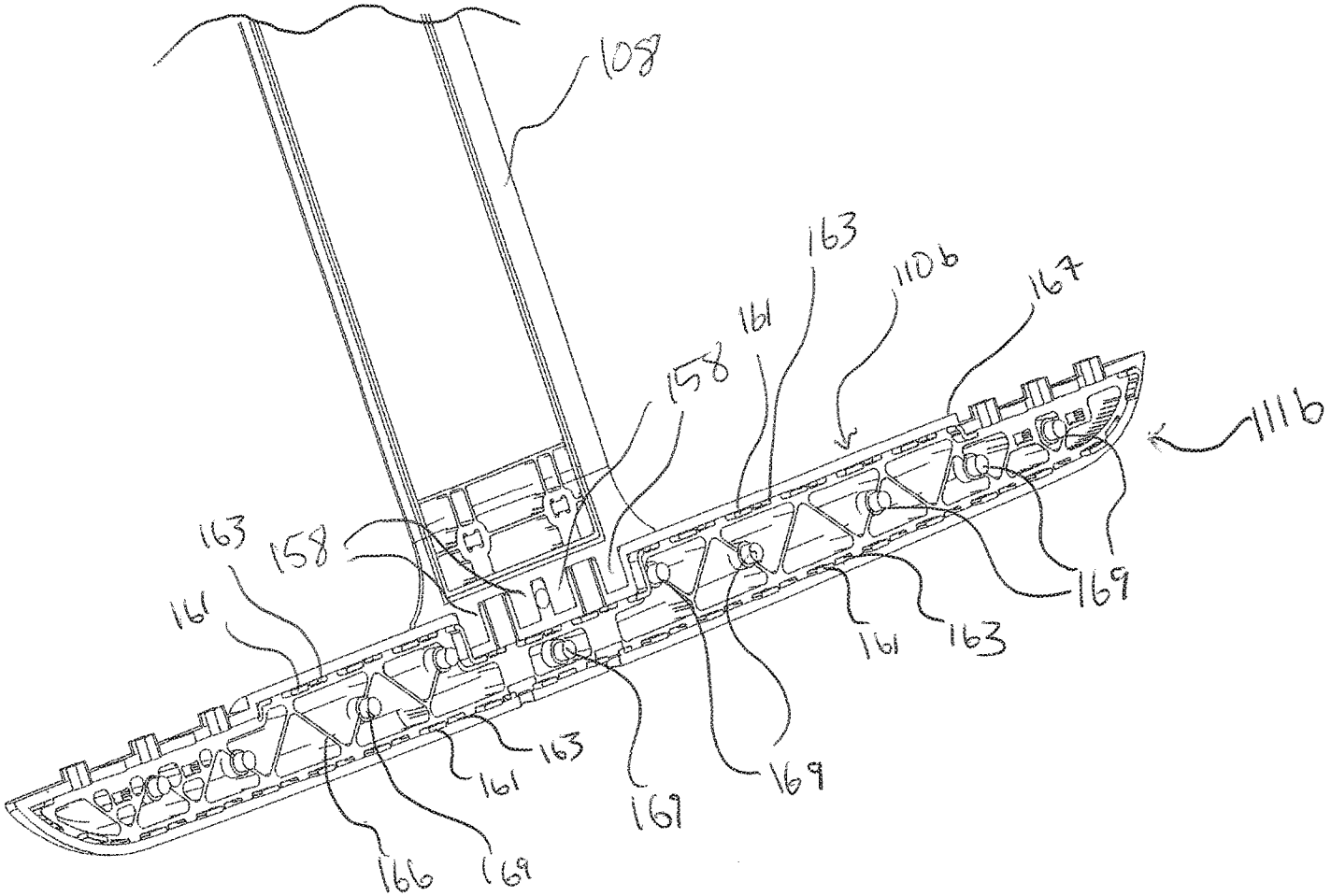
FIG. 12 shows a cross-sectional view of the hydrofoil of FIG. 7, with particular emphasis on the centerfoil second end and the fuselage, the wing and tail being omitted for clarity.
Figure 13:
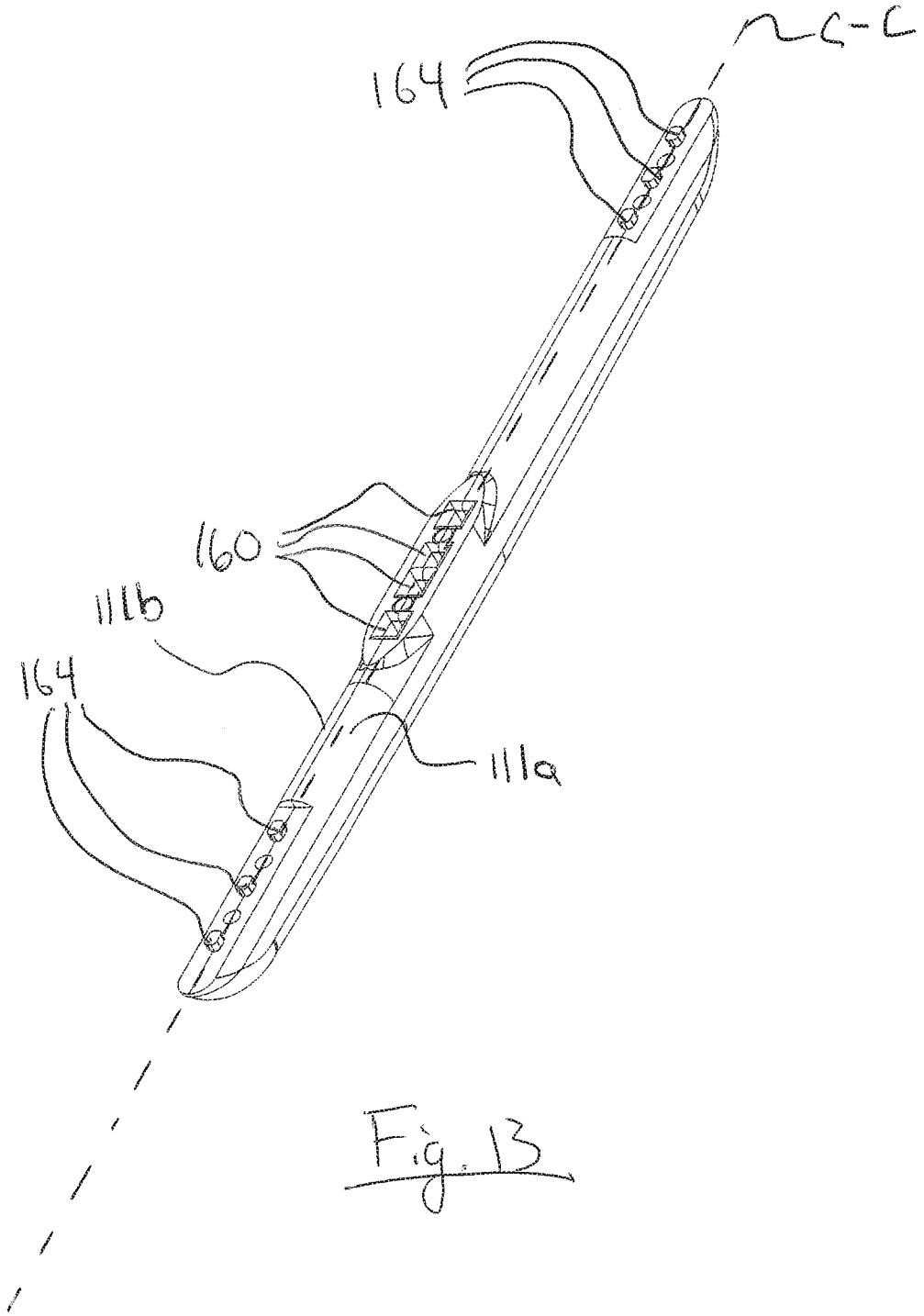
FIG. 13 shows a perspective view of one embodiment of the fuselage, the wing and tail being omitted for clarity.

Referring to FIGS. 7 and 12 through 13, the centerfoil second end 114 may be connected to the fuselage 111 by a second plurality of longitudinal projections 158. A second plurality of cavities 160 (FIG. 13) are sized to receive the second plurality of projections 158 and secure the foil assembly 110 to the centerfoil 108. The centerfoil second end 114 may be secured to the fuselage 111 via a plurality of fasteners (not shown). The wing 116 and tail 120 may be fixed to the fuselage 111 via a plurality of tabs 164 projecting from the fuselage first and second ends 118 and 122 and secured thereto by a plurality of fasteners 162.

Figure 12A:
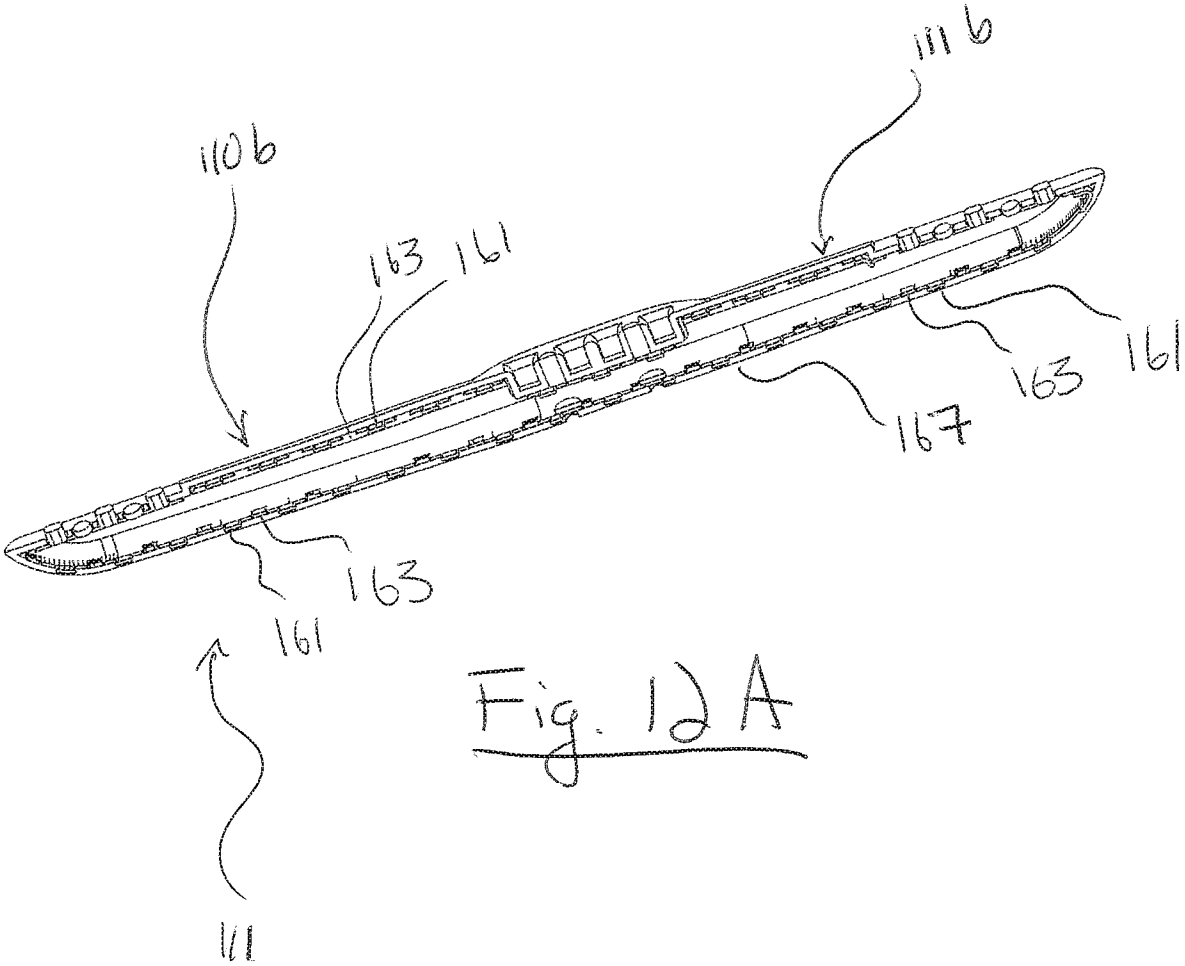
FIG. 12A shows a cross-sectional view of an alternative embodiment of the fuselage depicted in FIG. 12.

In the embodiment best seen in FIGS. 12, 12A and 13 the fuselage 111 has a central axis C-C oriented generally parallel to the base central axis B-B. The fuselage is formed from first and second halves 111*a* and 111*b*, which are mateable along the fuselage central axis B-B. The fuselage first and second halves 111*a* and 111*b* have a plurality of alternating tabs 161 and pockets 163 disposed at a periphery 167. The tabs and pockets 161 and 163 are configured around the periphery 167 such that the tabs 161 of the fuselage first half 111*a* fit within the pockets 163 of the fuselage second half 111*b* and vice versa. The tabs and pockets 161 and 163 stabilize to prevent the halves from shifting during use in a direction parallel to the longitudinal axis A-A of the centerfoil 108.

In one embodiment shown in FIG. 12A, the first and second halves 111*a* and 111*b* are hollow within the periphery 164. In an alternative embodiment shown in FIG. 12, a plurality of internal support ribs 166 are configured to criss-cross the fuselage within the periphery 167. The support ribs 166 provide structural support against torsional forces acting on the fuselage 111 when the hydrofoil 100 is being maneuvered during turns or in choppy water. The ribs 166 of the first half 111*a* may also include one of either a plurality of pegs 169 or a plurality of receptacles (not shown) configured to receive the pegs 169. The fuselage second half 111*b* has the other of the pegs 169 or receptacles (not shown) configured in a pattern complementary to the first half 111*a* such that the pegs 169 and receptacles mate and provide additional support against torsion and longitudinal movement of the halves.

Figure 14:
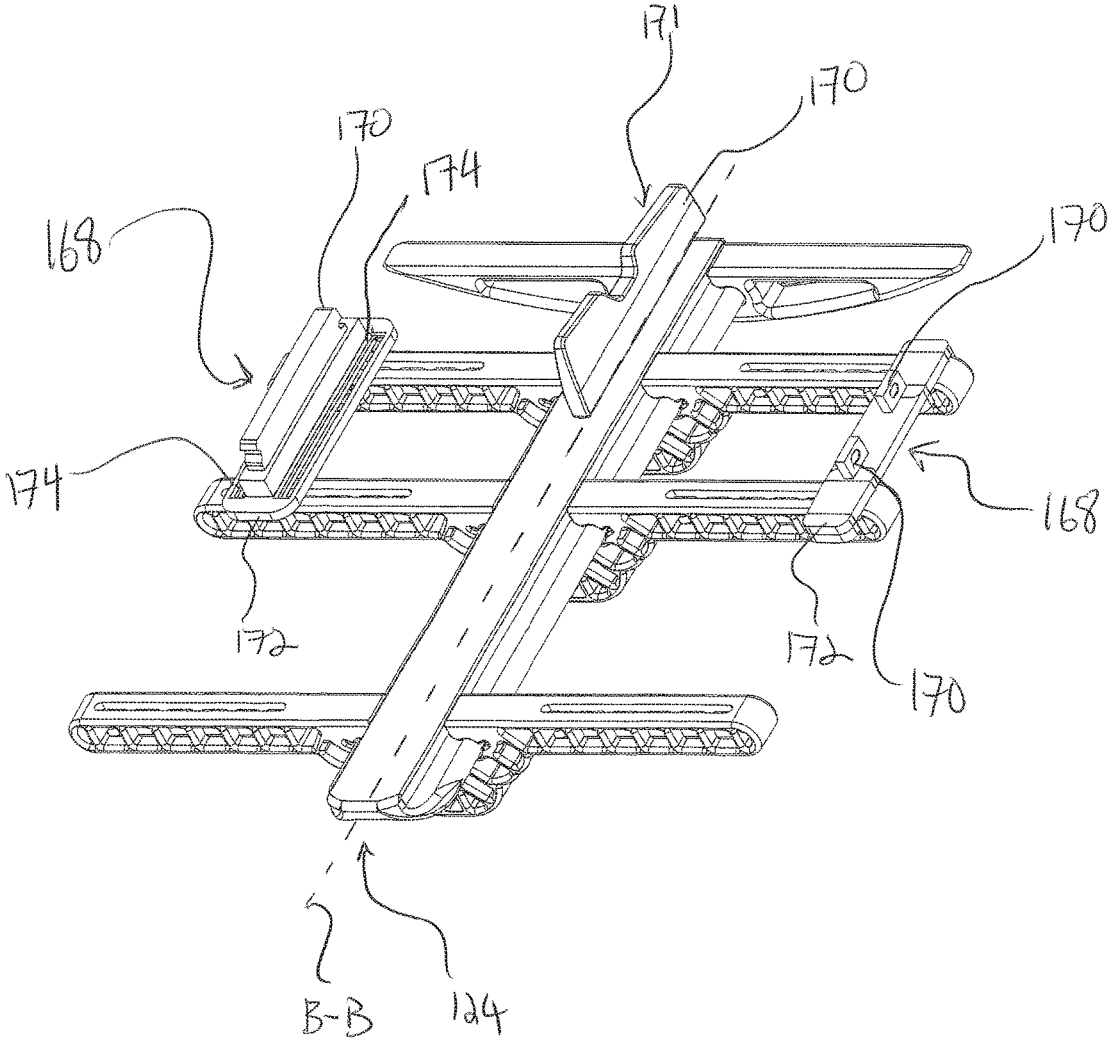
FIG. 14 shows one embodiment of the universal mount including two types of connectors.

As shown in FIGS. 14-17 and 23, any of a plurality of lateral connectors 168 are secured to the universal mount 102 to connect the universal hydrofoil 100 to a wide variety of craft. Referring specifically to FIG. 14, the lateral connectors 168 are utilized to secure the hydrofoil to any of a plurality of fin connector receptacles of a commercially available fin connector system used with a surf-style water sports board such as a surfboard, stand-up paddleboard, wakeboard, kiteboard, or windsurfer.

The lateral connectors 168 comprise a fin connector assembly 170 and an attachment assembly 172. The attachment assembly 172 may comprise a plate defining a pair of generally parallel connector channels 174 on either side of the fin connector assembly 170 which allow for adjustment in the fore-aft direction. The slideable connection between the central beam 140 of the lateral supports 136 allows for major adjustments in the fore-aft direction, while the connector channels 174 of the attachment assembly allow for smaller adjustments to fine tune the fit of the hydrofoil 100 to the surfboard. The attachment assembly is secured to the arm 138 via the lateral channels 142, allowing the lateral connectors 168 to be adjusted in a lateral direction as well as the fore aft direction.

Figure 15:
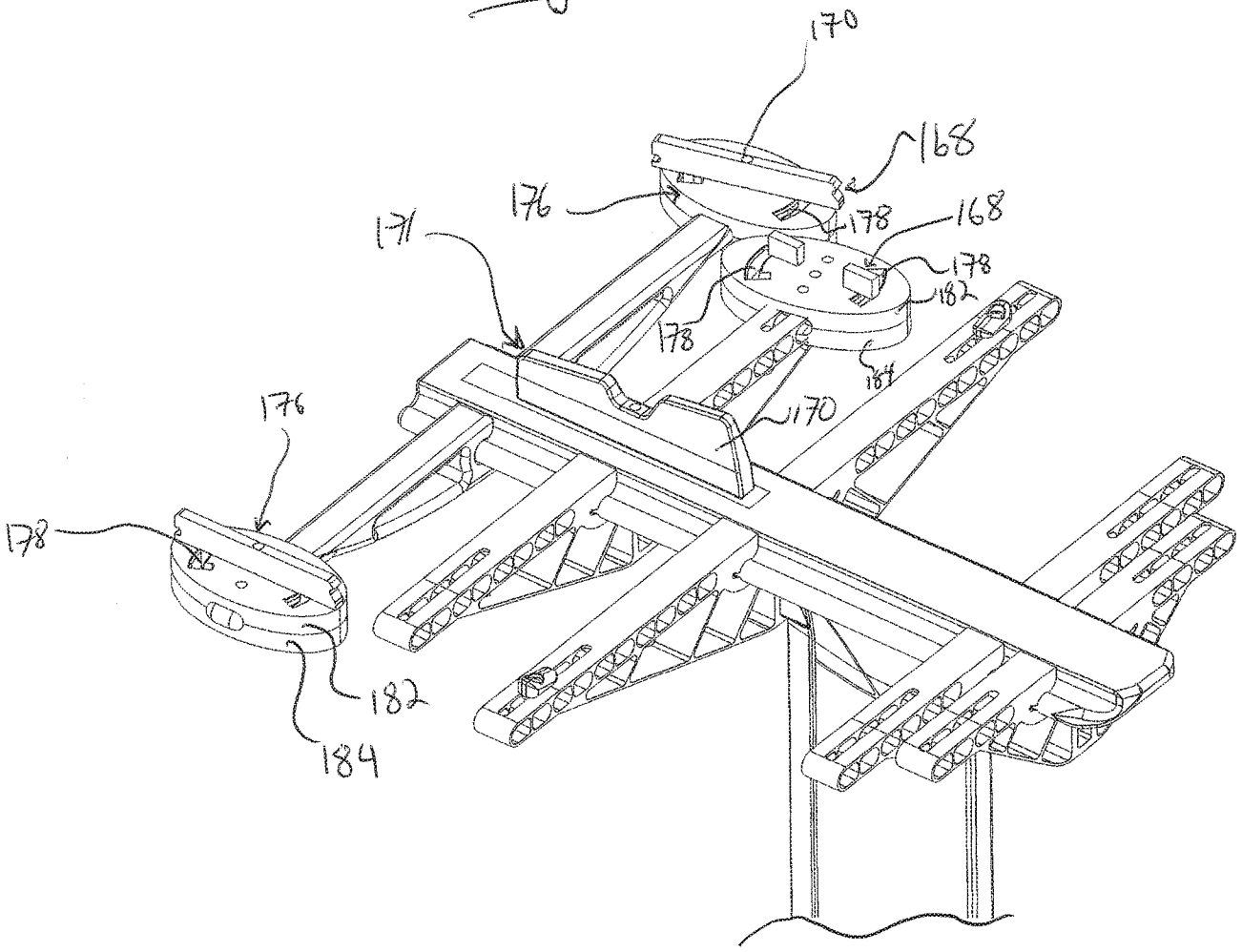
FIG. 15 shows an alternate embodiment of the universal mount of FIG. 15 including a plurality of pads for use with the connectors.

In the embodiment shown in FIGS. 14 and 15, the fin connector assembly 170 projects generally perpendicularly from the attachment assembly, and comprises a single longitudinally extending tab or alternatively a pair of spaced tabs. The fin connector assembly 170 may be adapted in any of a variety of ways to accommodate various fin fixing elements without departing from the scope of the current disclosure.

A center fin connector 171 is used in connection with the embodiment of the base 124 defining the central slot 125. The center fin connector 171 may be used with a board utilizing a thruster or single fin arrangement. In the case of a thruster fin arrangement, the center fin connector 171 and at least one lateral support 136 to which two lateral connectors 168 are secured to the arms 138 are utilized. Unlike the lateral connectors 168 secured to the lateral support 136, the center fin connector 171 cannot be adjusted in the fore-aft direction in the disclosed embodiment.

In the case of a single fin arrangement, the center fin connector 170 may secure the hydrofoil 100 to the board without additional connectors, however additional lateral support may still be necessary. As shown in FIG. 15, an angled pad 178 pre-stresses the arms 138, providing an added measure of lateral support without a lateral connector 168.

Figure 16:
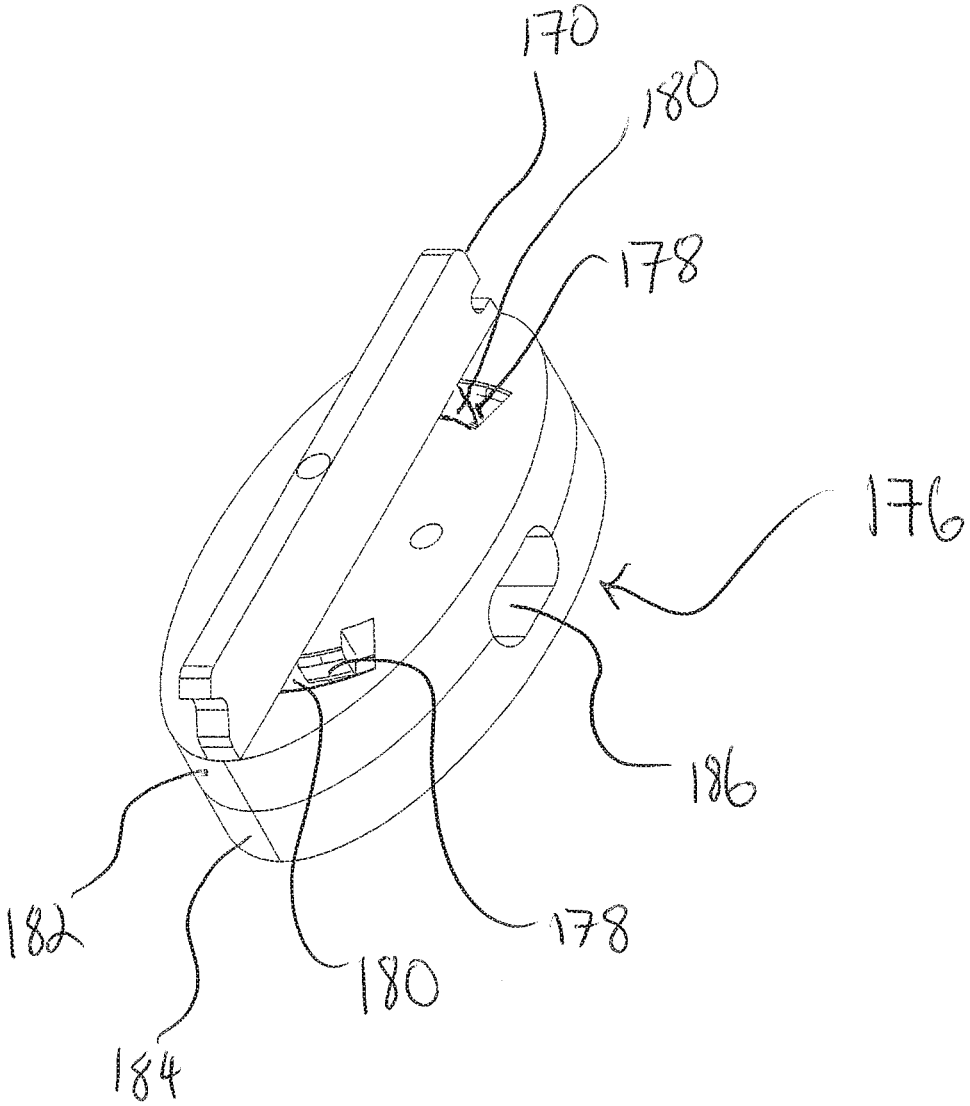
FIG. 16 shows a perspective view of one of the pads of FIG. 15.
Figure 17:
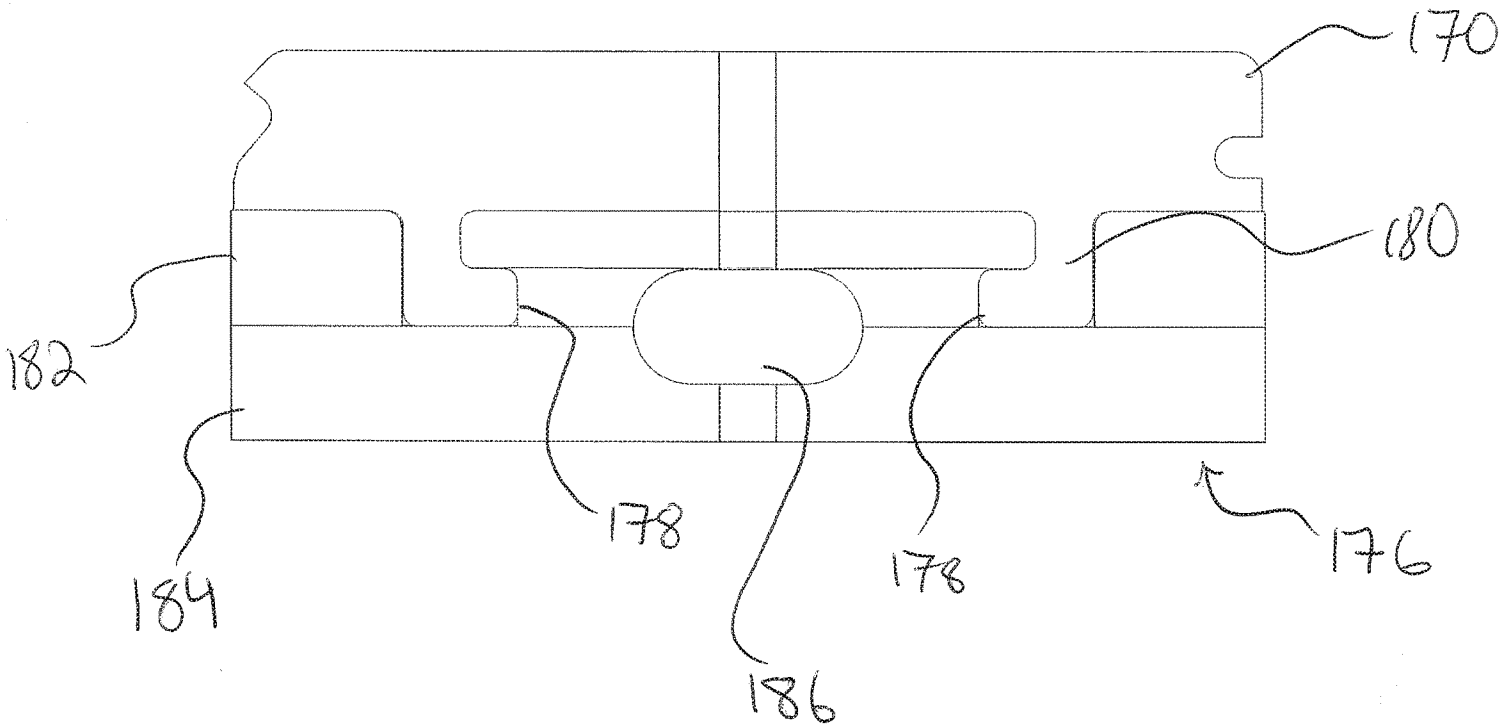
FIG. 17 shows a cross-sectional view of the pad shown in FIG. 16.

In the embodiment shown in FIG. 15-17, the lateral connectors 168 are configured for use with a plurality of pads 176. Each of the pads 176 defines an arcuate slot 178 on one surface thereof which defines a female portion of a bayonet connector system. A male portion of the bayonet connector system 180 projects from a surface of the attachment assembly 172 opposite the fin connector assembly 170. The pads may comprise first and second halves 182 and 184 which cooperate to define a laterally oriented bore 186 sized to receive the arms 138 of the lateral supports 136. Once the pads 176 are secured to the lateral support 136 at the appropriate lateral position, a fastener (not shown) secures the pad 176 to the arms 138.

The lateral and fore aft adjustability of the lateral connectors 168 and the wide assortment of configurations of the fin connector assembly 172 allow the hydrofoil to be used with virtually any number and arrangement of fin fixing elements.

Figure 23:
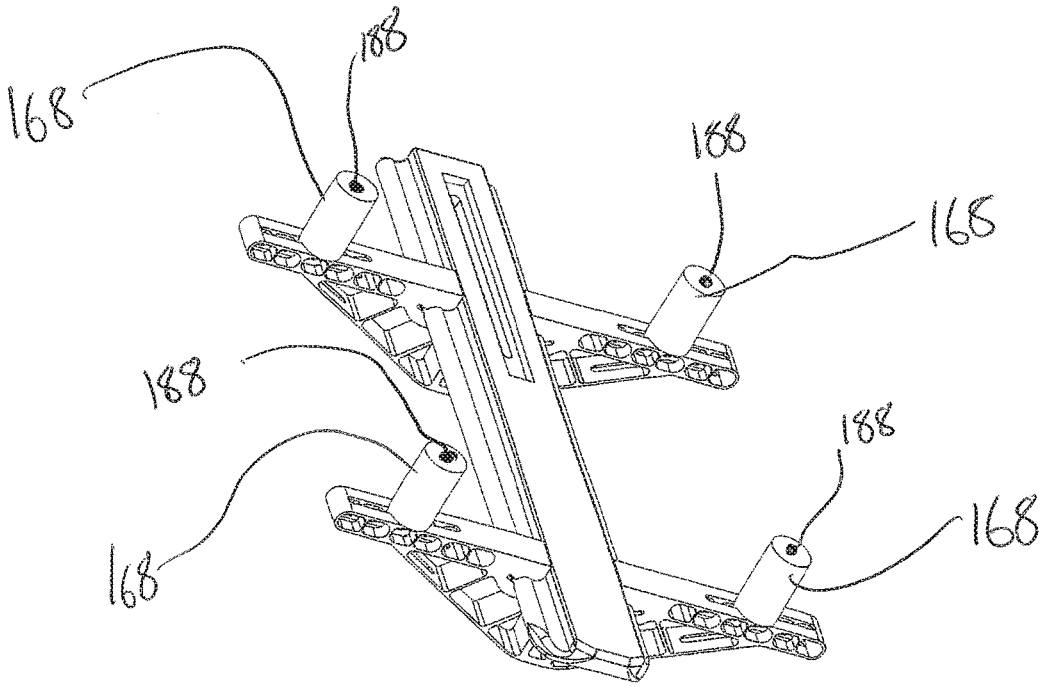
FIG. 23 shows a perspective view of an alternative embodiment of the connectors to that shown in FIGS. 14 and 15.

In the embodiment shown in FIG. 23, the connectors 168 comprise a plurality of cylinders. The cylinders are configured for use with a self-propelled water craft such as a sit-on-top kayak (not shown). The cylinders may comprise a collet, which defines a hole 188 configured to receive a threaded fastener (not shown). The cylinders are sized to be received within a void defined in the bottom of a sit-on-top kayak, and expand upon receiving the threaded fastener, securing the hydrofoil to the bottom of the kayak.

A plurality of alternative embodiments may be utilized to adapt the hydrofoil 100 for use with a self-propelled water craft. For example, as indicated by the dashed line in FIG.

Figure 21:
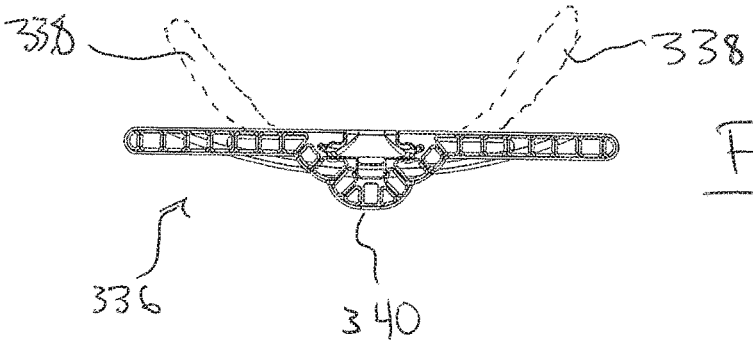

20, the arms 238 may project angularly away from the central beam 240 of one embodiment of the lateral supports configured for use with a racing kayak, or other self-propelled watercraft having a steep hull. Alternatively, the arms 338 of the lateral supports 336 in the embodiment shown in FIG. 21 project arcuately away from the central beam 340 and are configured for use with a craft having a more arcuately shaped hull such as a canoe or recreational kayak. The arms 238 and 338 may be connected to the self-propelled water craft by a series of straps (not shown).

In one embodiment the hydrofoil is manufactured using polypropylene and high density polyethylene. In another embodiment polypropylene and high density polyethylene are internally reinforced with fibers known for their high strength to weight characteristics, such as Kevlar, fiberglass, or carbon. The hydrofoil assembly may also be constructed to be buoyant in both salt and fresh water. Any durable material having a density less than 1000 kilograms per cubic meter may be used.

In one embodiment, the hydrofoil assembly 104 is connected to the universal mount 102 via a breakaway connection. A plurality of breakaway connectors (not shown) secure the hydrofoil assembly 104 to the universal mount assembly 102. The breakaway connectors are structurally designed so that the universal mount assembly 102 and the board (not shown) will detach from the hydrofoil assembly 104, if a predetermined force is exerted on the hydrofoil assembly. This feature ensures rider safety and prevents damage to the board if the hydrofoil hits a rock, a coral reef, or a similar submerged obstacle.

While preferred embodiments have been set forth for purposes of illustration, the foregoing description should not be deemed a limitation of the invention herein. Accordingly, various modifications, adaptations and alternatives may occur to one skilled in the art without departing from the spirit of the invention and the scope of the claimed coverage.

The invention claimed is:

1. A universal hydrofoil assembly connectable to a plurality of anchor points on a craft having a fore and aft and defining a direction of travel comprising:

a hydrofoil assembly having a longitudinal axis and comprising a centerfoil coaxial with said longitudinal axis and having first and second longitudinal ends, a fuselage defining a central axis and connected to said centerfoil at said first longitudinal end and having a wing and a tail;

a universal mount assembly comprising a base having a hydrofoil mounting interface defining a central mounting axis and a plurality of connectors configured to engage a said anchor point on the craft so that said central mounting axis is parallel to the direction of travel, wherein said connectors are selectively adjustably positionable in a direction parallel to the direction of travel for selective fixed cooperation with the anchor points of the craft and said centerfoil second end is detachably fixedly mounted to said mounting interface.

2. The universal hydrofoil assembly of claim 1, wherein said connectors are laterally spaced from said central mounting axis.

3. The universal hydrofoil assembly of claim 1, wherein said centerfoil second end is mountable to said hydrofoil mounting interface in a plurality of positions along said central mounting axis.

4. The universal hydrofoil assembly of claim 1, wherein said base comprises a structure which laterally extends from said central axis and is configured to be generally complementary to the general underside of the craft.

5. The universal hydrofoil assembly of claim 1, wherein said centerfoil second end has a plurality of longitudinal projections and said mounting interface comprises a structure defining a plurality of cavities sized to receive said longitudinal projections of said centerfoil first end, to adjustably mount said hydrofoil assembly to said universal mount assembly such that a mounted position of said centerfoil is adjustable along the direction of travel.

6. The universal hydrofoil of claim 1, wherein said centerfoil second end has a single longitudinal projection and said mounting interface comprises a structure defining a single cavity oriented coaxial with said central axis of said base and configured to receive said longitudinal projection to mount said hydrofoil assembly to said universal mount.

7. The universal hydrofoil of claim 1, wherein said centerfoil first end has a single longitudinal projection and said fuselage defines a single cavity sized to receive said longitudinal projection to mount said centerfoil to said fuselage.

8. The universal hydrofoil of claim 1, wherein said craft is selected from the group consisting of a surfboard, a windsurfer, a kiteboard, a kayak and a wakeboard.

9. A watercraft with a universal mount hydrofoil comprising:

a watercraft having a fore and aft and defining a direction of travel;

a universal mount assembly comprising a base having a hydrofoil mounting interface defining a central mounting axis and a watercraft mounting assembly which slidably displaceably adjustably mounts said base to said watercraft at a multiplicity of positions along the direction of travel; and a hydrofoil assembly comprising a centerfoil having axially first and second ends and a fuselage assembly connected to said first end and said second end fixedly mounted to said hydrofoil mounting interface, wherein said fuselage assembly and centerfoil are parallel to the direction of travel and are axially spaced from said watercraft.

10. The watercraft and universal hydrofoil of claim 9, wherein said second longitudinal end is detachably engageable with said mounting interface of said base.

11. The watercraft and universal hydrofoil of claim 9, wherein said universal mount assembly comprises a pair of laterally spaced elongated structures defining slots.

12. The watercraft and universal hydrofoil of claim 9, wherein said centerfoil second end has a plurality of longitudinal projections and said mounting interface comprises a structure defining a plurality of cavities sized to receive said longitudinal projections of said centerfoil first end, to adjustably mount said hydrofoil assembly to said mounting interface.

13. The watercraft and universal hydrofoil of claim 9, wherein said centerfoil first end has a single longitudinal projection and said fuselage defines a cavity sized to receive said longitudinal projection to mount said centerfoil to said fuselage.

14. The watercraft and universal hydrofoil of claim 9, wherein said watercraft mounting assembly comprises four connectors which implement a connecting force generally perpendicular to the direction of travel detachably engageable with said mounting interface of said base.

15. The watercraft and universal hydrofoil of claim 9, wherein said hydrofoil assembly is fixedly mountable to said hydrofoil mounting interface at a plurality of positions along said central axis.

16. A universal hydrofoil assembly comprising:

a hydrofoil assembly having a longitudinal axis and including a centerfoil coaxial with said longitudinal axis and having first and second longitudinal ends, a foil assembly disposed at said centerfoil first end including a fuselage having a wing at a fuselage first end and a tail at a fuselage second end;

a universal mount assembly comprising a base having a central axis perpendicular to said longitudinal axis and having first and second mounting surfaces, said second mounting surface defining a mounting interface configured to mount said centerfoil first end and extending in a mounting direction parallel or coaxial with said base central axis; and a plurality of connectors carried by said universal mount assembly and laterally spaced relative to said central axis and adjustably positionable and configured to fixedly engage a structural feature of a craft;

wherein said second longitudinal end of said centerfoil is engageable with said mounting interface of said base at a plurality of fixed positions along said mounting direction.

17. The universal hydrofoil assembly of claim 16, wherein said base comprises an elongate track configured coaxial with said central axis and having a pair of rails projecting laterally adjacent said second surface and each defining a groove parallel to said central axis, and a lateral support having a central beam and said central beam of said lateral support includes a pair of fingers defining a pair of pockets configured to secure said lateral support to said base at said rails such that said fingers engage said grooves and said pockets receive said rails.

18. The universal hydrofoil assembly of claim 17, wherein said central beam comprises an arcuate segment defining a first cutout sized to receive a first stabilizer projecting at said centerfoil first end in a direction parallel with said base central axis and transverse to said longitudinal axis.

19. The universal hydrofoil assembly of claim 16, wherein each of said connectors comprises a fin insert assembly and an attachment assembly, said fin insert assembly configured for use with a pre-existing fin connector receptacle for a surf-style water craft.

20. A universal hydrofoil assembly mountable to a water craft having a fore and aft and defining a direction of travel:

a hydrofoil assembly comprising a centerfoil having axially spaced first and second ends and a fuselage assembly connected to said first end; and a universal mount assembly comprising a base having a hydrofoil mounting interface and a water craft mounting assembly which mounts said base to said water craft and comprising a hydrofoil mounting interface which fixedly mounts said hydrofoil assembly second end;

wherein said hydrofoil assembly is slidably positionable along said direction of travel at a multiplicity of positions and is selectively fixably mounted at each of said positions relative to said water craft.

* * * * *